United States Patent [19]

Campbell

[11] 4,056,452

[45] Nov. 1, 1977

[54] ELECTROLYSIS APPARATUS

[75] Inventor: Barrie C. Campbell, Provo, Utah

[73] Assignee: Billings Energy Research Corporation, Provo, Utah

[21] Appl. No.: 661,788

[22] Filed: Feb. 26, 1976

[51] Int. Cl.[2] ..... C25B 1/02; C25B 11/02

[52] U.S. Cl. ..... 204/258; 204/266; 204/278; 204/282; 204/289; 204/290 R

[58] Field of Search ..... 204/252, 253, 255, 256, 204/257, 258, 263, 269, 282, 283, 284, 290 R, 301, 289, 266

[56] References Cited

U.S. PATENT DOCUMENTS

| | | | |
|---|---|---|---|
| 1,152,772 | 9/1915 | Wheeler | 204/283 |
| 2,990,361 | 6/1961 | Solt | 204/301 |
| 3,124,520 | 3/1964 | Juda | 204/283 X |
| 3,216,920 | 11/1965 | Nellen | 204/301 |
| 3,312,614 | 4/1967 | Schick | 204/266 |
| 3,446,725 | 5/1969 | Spengler et al. | 204/283 X |
| 3,553,092 | 1/1971 | Mund et al. | 204/301 |
| 3,855,104 | 12/1974 | Messner | 204/278 X |
| 3,981,745 | 9/1976 | Stedman | 204/266 |

*Primary Examiner*—Arthur C. Prescott
*Attorney, Agent, or Firm*—Criddle, Thorpe & Western

[57] ABSTRACT

Disclosed is an electrolyzer which includes a plurality of partitions, each of which are hollowed out on either side thereof, a plurality of substrates, each of which is disposed in the hollow of a different one of said partitions and each of which is corrugated on one side thereof, with the corrugated side coated with an anodic material, a plurality of solid polymer electrolyte membranes, one side of each of which is disposed in contact with the anodic material of a different one of said substrates, and a plurality of cathode plates composed of porous cathodic material, each of which is disposed in the other hollow of a different one of the partitions and is positioned in contact with the other side of a different one of the membranes. The partitions, substrates, membranes and cathode plates are secured together in a series relationship with the corrugated side of each substrate being held in contact with one side of a membrane and each cathode plate being held in contact with the other side of a corresponding membrane. Channels are formed in the corrugated side of the substrates to convey water to the grooves formed by the corrugations, and a conduit is formed to extend through the partitions to deliver water to the channels. Other channels are formed in the substrates to receive water and electrolysis products from the grooves and to deliver the water and products to a second conduit formed in the partitions. A third conduit is formed in the partitions to receive electrolysis products at the interfaces of the membranes and cathode plates. A direct current source supplies current to the substrates and cathode plates to cause an electrolytic reaction when water is supplied to the grooves of the corrugated sides of the substrates.

21 Claims, 11 Drawing Figures

ELECTROLYSIS APPARATUS

BACKGROUND OF THE INVENTION

This invention relates to electrolysis apparatus and to electrode structure in such apparatus.

As a result of recent shortages in hydrocarbon fuels and the recognition that the supply of such fuels will ulimately be exhausted, there has naturally been an increased interest in finding and developing alternative fuels. Hydrogen, being one of the most abundant of all elements and being relatively pollution free when burned, is considered one of the more attractive alternatives to hydrocarbon fuels, and electrolysis is considered one of the more attractive and economically feasible methods of producing hydrogen.

Prior art electrolytic cells have typically included a container of some type for holding a liquid electrolyte and a pair of electrodes immersed in the electrolyte. Application of direct current across the electrodes produces an electrochemical reaction in which the electrolyte is decomposed into one or more gas products. For example, with an aqueous electrolyte, oxygen and hydrogen may be produced.

Because of the inefficiencies, portability drawbacks, and unreliability of the liquid electrolyte cells, considerable interest has centered on a fairly new technology involving solid polymer electrolytes (SPE). See, for example, "Solid Electrolytes Offer Route to Hydrogen", Chemical and Engineering News, Aug. 27, 1973; "Electrolytic Hydrogen Fuel Production with Solid Polymer Electrolyte Technology" by W. A. Titterinton and A. P. Fickett, VIII IECEC Proceedings; and "A Hydrogen-Energy System", published by American Gas Association, 1973. As described in these references, SPE is typically a solid plastic sheet of perfluorinated sulfonic acid polymer which, when saturated with water, becomes an excellent ionic conductor. The ionic conductivity results from the mobility of the hydrogen ions which move through the polymer sheet by passing from one sulfonic acid group to another. An anode and cathode are positioned on either side of the sheet and pressed thereagainst to form the desired SPE cell.

Hydrogen is produced by the SPE cell by supplying water to the anode where it is electrochemically decomposed to provide oxygen, hydrogen ions, and electrons. The hydrogen ions move through the SPE sheet to the cathode while the electrons pass through the external circuit. At the cathode, the hydrogen ions and the electrons recombine electrochemically to produce hydrogen gas.

Although the prior art SPE cell described provides a reliability and efficiency not achieved with the liquid electrolyte cell, the cell still requires noble metal catalysts and thus is quite costly. In addition, cell breakdown is more frequent than is desirable.

SUMMARY OF THE INVENTION

It is an object of the present invention to provide new and less costly electrolysis apparatus especially adapted for use in producing hydrogen.

It is another object of the present invention to provide electrolysis apparatus which accommodates and facilitates the arrangement of a plurality of electrolytic cells in a compact and efficient series arrangement.

The above and other objects of the present invention are realized in an electrolysis apparatus electrode structure having a solid polymer electrolyte membrane and a pair of electrodes disposed on either side of and in contact with the membrane. At least one of the electrodes includes a corrugated portion which presents alternating ridges and grooves. The top of the ridges are maintained in contact with the membrane and the bottoms of the grooves are spaced from the membranes to enable the flow of fluid through the grooves.

In accordance with one aspect of the invention, the membrane is pressed against the tops of the ridges. This provides good surface contact between the corrugated electrode and the membrane to thereby facilitate an electrolytic reaction at the interface of the electrode and membrane.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
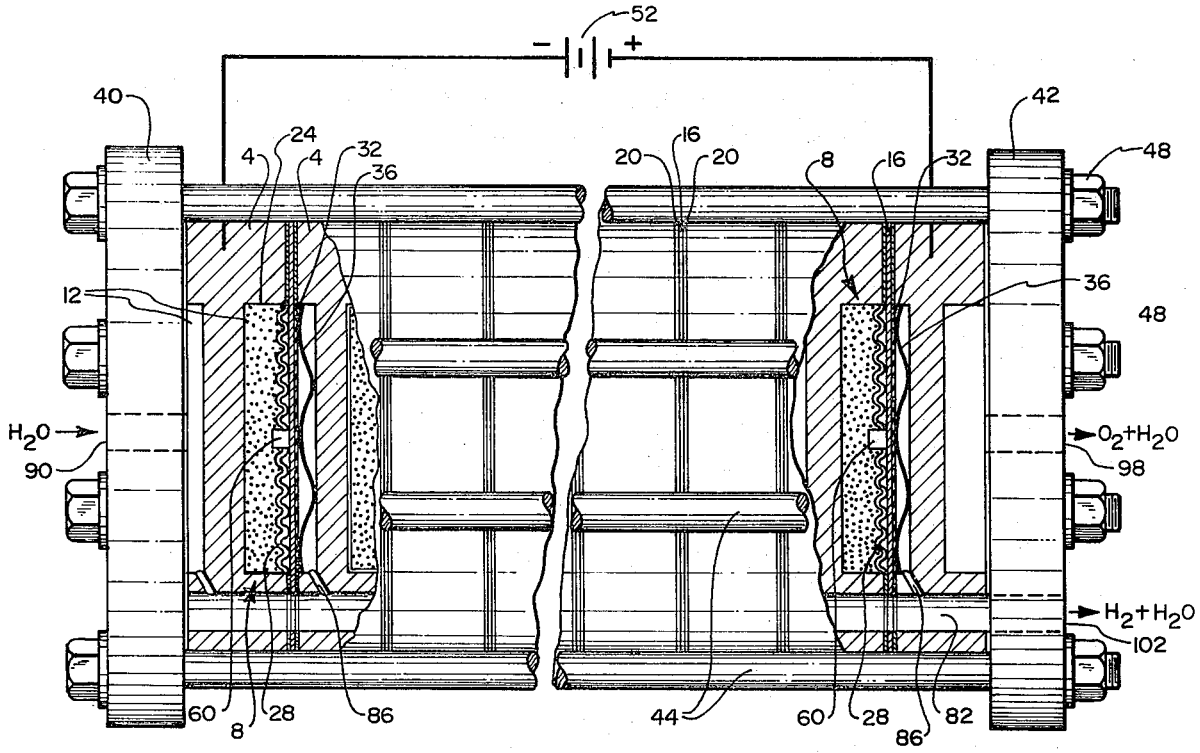
FIG. 1 shows a side, partially cut away, cross-sectional view of electrolysis apparatus made in accordance with the principles of the present invention.

FIG. 1 is a side, partially cut away, cross-sectional view of electrolysis apparatus which includes a plurality of electrolytic cells arranged in a series relationship. Although a particular electrode structure will be described for the apparatus of FIG. 1, other electrode structures will be discussed later on which could be incorporated in the FIG. 1 apparatus or apparatus similar to that shown in FIG. 1.

Figure 2A:
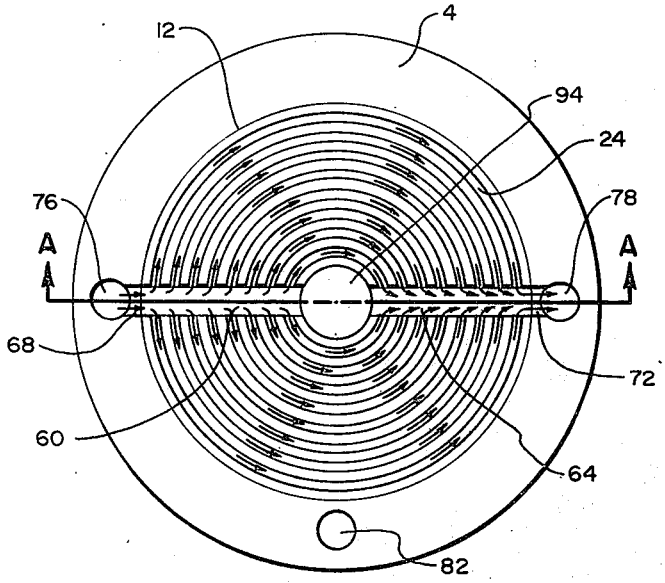
FIGS. 2A and 2B respectively show a top plan view of an exemplary partition and anode plate of the apparatus of FIG. 1 and a cross-sectional view taken along lines A—A of the partition and plate of FIG. 2A.

The electrolyzer of FIG. 1 includes a plurality of partitions 4 for separating and dividing a plurality of electrolytic cells 8. Each partition 4 is circular, as best seen in FIG. 2A, and is formed to provide hollows 12 on either side thereof. The hollows 12 are also generally circular, again as best seen in FIG. 2A. The partitions may illustratively be constructed of aluminum alloy. The primary requirements of the partitions 4 are that the partitions be capable of conducting an electric current, of withstanding pressure which may be developed in the electrolyzer, and of withstanding corrosion and rust from the cell reactants and products.

The partitions 4 are arranged in a series relationship as indicated in FIG. 1 with a solid electrolyte membrane 16 disposed between each adjacent pair of partitions. The membranes, which are generally circular and which have perimeters substantially coterminous with the perimeters of the partitions, divide and separate contiguous hollows 12 of adjacent pairs of partitions 4. A pair of annular gaskets 20 are disposed on either side of each membrane 16 to prevent contact between the partitions 4 and the membranes. The gaskets each have a central circular opening which is substantially the same size as the hollow openings. The membranes 16 may be any suitable solid polymer electrolyte material but it has been found that perfluorosulfonic acid membranes known as "nafion" and produced by Du Pont Corporation, are especially desirable. The gaskets 20 could advantageously be constructed of teflon. The thicknesses of the membranes and the gaskets could be a variety of different values but it has been found that a thickness of 1/32 inches provides a sufficiently strong construction while facilitating compactness and economy of the apparatus.

Each cell 8 of the apparatus includes an anode plate composed of a substrate 24 positioned on one side of a corresponding membrane 16 in one of the hollows 12 of the partitions 4. The substrates 24 substantially fill the hollows of the partitions in which they are placed so that one side of each substrate is maintained in contact with one side of a corresponding membrane 16. The side positioned in contact with the membrane is corrugated, as generally indicated in FIG. 1, to present alternating ridges and grooves. The tops of the ridges are in contact with the membrane and the groove bottoms are spaced from the membrane to enable the flow of fluid through the grooves. The substrate material may advantageously be graphite or other suitable electrode material.

The corrugated side of each substrate 24 is coated with a layer 28 of anodic material such as lead dioxide. The use of such anodic material is described further in copending patent application, Ser. No. 661,789.

Positioned on the other side of each membrane 16 and in the facing hollow of the adjacent partition 4 is a cathode plate 32. The plate is composed of a porous cathodic material suitable for allowing the flow of fluids therethrough. Advantageously, such material is sintered nickel as described in further detail in the aforecited copending application. The cathode plates may be laminated onto the membranes or pressed into contact with the membranes by means of wave springs 36 or other biasing elements disposed between the bottoms of the hollows in the partitions and the corresponding cathode plates.

The partitions 4, membranes 16, gaskets 20, substrates 24 and cathode plates 26 are maintained in the series relationship shown in FIG. 1 by a pair of end plates 40 and 42 positioned at either end of the series. The end plates 40 and 42 are urged together by tie bolts 44 which extends through openings in the end plates and are secured by nuts 48. The partitions 4 and other components of the cells are disposed within the encirclement of the bolts 44 and insulated therefrom.

A direct current source 52 is coupled to each partition 4 at either end of the series arrangement, as shown in FIG. 1, to supply current to the anode and cathode of each electrolytic cell 8. This produces an electrolytic reaction in the cells when water is supplied to the cells as hereafter discussed.

FIG. 2A shows a top view of an illustrative substrate 24 disposed in the hollow 12 of a partition 4. The substrate 24, of course, is circular and has formed on one face thereof a plurality of concentric ridges and grooves. A cross-section showing the ridges and grooves is given in FIG. 2B. A pair of channels 60 and 64 (FIG. 2A) are formed in the face of the substrate 24 to extend radially from near the center of the substrate outwardly through the ridges and grooves. (An end view of the channel 60 is shown in FIG. 1.) The outer ends of the channels 60 and 64 are coupled via lateral conduits 68 and 72 formed in the partition 4 to conduits 76 and 78 also formed in the partition to extend generally perpendicularly to the plane defined by the partition. The conduits 76 and 78 extend through all of the partitions of the apparatus. A third conduit 82 is formed to extend through the partitions generally parallel with the conduits 76 and 78 (see FIG. 1). Conduit 82 communicates via lateral conduits 86 with the hollows 12 formed in one side of the partitions 4 as shown in FIG. 1. A brief description of the operation of the apparatus of FIG. 1 will now be given.

Figure 2B:
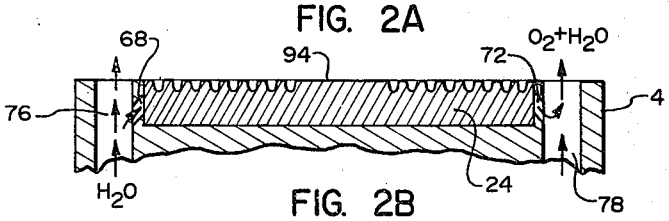

Referring to FIGS. 1, 2A and 2B, it is seen that water is supplied to the elctrolytic cells through an opening 90 (FIG. 1) in the end plate 40 to the conduit 76 to thereby convey water through the lateral conduits 68 to the channels 60 formed in the substrates. Because of a rise 94 formed in the center of the substrate 24 (FIG. 2B) to separate the two channels 60 and 64, the water flows (as indicated by the arrows) from the channel 60 into the grooves formed in the substrate and through the grooves to the channel 64. Application of water to the lead dioxide anode/membrane interfaces, together with the application of direct current to the anodes causes an electrolytic reaction resulting in the production of hydronium ions and these ions migrate through the membranes to the membrane/cathode interfaces where they combine with electrons supplied by the cathodes to produce water and hydrogen. Oxygen is also produced at the anode/membrane interfaces and the water and oxygen flow to the channels 64 and from there via the lateral conduits 72 to the conduit 78 and ultimately out an opening 98 formed in the end plate 42 (FIG. 1). The water and hydrogen produced at the membrane/cathode interfaces flow through the porous cathode plates 32 into the chambers defined by the hollows in the partitions in which the cathode plates are disposed and from there via lateral conduits 86 into the conduit 82 and then through an opening 102 formed in the end plate 42 (FIG. 1). Of course, the oxygen and water from conduit 78 and the hydrogen and water from conduit 82 may be collected in suitable containers for subsequent use. In this manner, hydrogen gas may be efficiently and conveniently produced. The electrolytic reaction which results in the production of hydrogen gas is discussed in greater detail in the previously cited copending application.

Figure 2C:
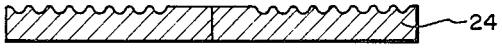
FIG. 2C is a cross-sectional view of another embodiment of an anode plate which could be utilized in the apparatus of FIG. 1.

FIG. 2C shows a cross-sectional view of an alternative ridge and groove structure for the substrate 24 of FIGS. 1, 2A and 2B. While the grooves shown in FIG. 2B are of generally uniform width and depth and thus uniform cross-sectional area, the grooves in the substrate of FIG. 2C have varying cross-sectional areas. In particular, the cross-sectional area of the grooves formed near the outer edges of the substrate of FIG. 2C is greater than the cross-sectional area of the grooves formed near the center. With this groove construction, water applied to the channel 60 (also formed in the substrate 24 of FIG. 2C but not specifically shown) would tend to more readily flow through the outermost grooves (even though they are longer) because of their greater cross-sectional area. With the groove configuration of FIG. 2B, the water would tend to flow along the shortest paths to the channel 64 and thus would tend to flow through the innermost grooves more readily than the outermost grooves. Of course, it is desirable that water flow as uniformly as possible through all of the grooves to expose a greater proportion of the anode/-membrane interface to the water to thereby bring about the electrolytic reaction. The groove configuration of FIG. 2C would thus tend to improve the uniformity of water flow through the grooves.

Figure 3:
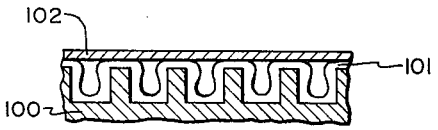
FIG. 3 is a fragmented, cross-sectional view of exemplary groove and ridge structure for electrode plates made in accordance with the principles of the present invention.

FIG. 3 shows one illustrative configuration for the formation of grooves in an electrode plate substrate. With this configuration, grooves having a generally rectangular cross-section are formed in a substrate 100 and then the surface of the substrate is coated with anodic or cathodic material 101. The coating 101 formed on the substrate presents channels having a horseshoe-spaced cross-section and ridges having substantially flat top surfaces. Thus, good surface contact between a membrane 102 and the ridges is maintained while fairly wide grooves or channels are provided for conveying water.

Figure 4:
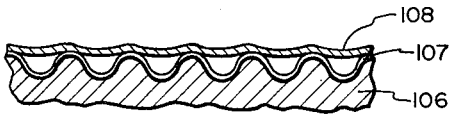
FIG. 4 is a fragmented, cross-sectional view of another exemplary groove and ridge structure of an electrode plate.

FIG. 4 shows another alternative groove configuration for electrode plates. In this configuration, the grooves are formed in a substrate 106 to have a generally V-shaped cross-section, but with generally rounded bottoms. The tops of the ridges are also generally rounded so that when a layer of anodic or cathodic material 107 is applied to the substrate, the layer is similarly formed to have generally rounded ridge tops and groove bottoms as shown in FIG. 4. The substrate 106 is then positioned against a membrane 108 so that the membrane partially deforms to conform in shape to the tops of the ridges. In this manner, greater contact between the tops of the ridges and the membranes is maintained and yet the membranes is still spaced from the groove bottoms to facilitate the flow of water. It has been found that this groove configuration is also efficient in promoting electrolytic reaction at the electrode/membrane interface.

Figure 5A:
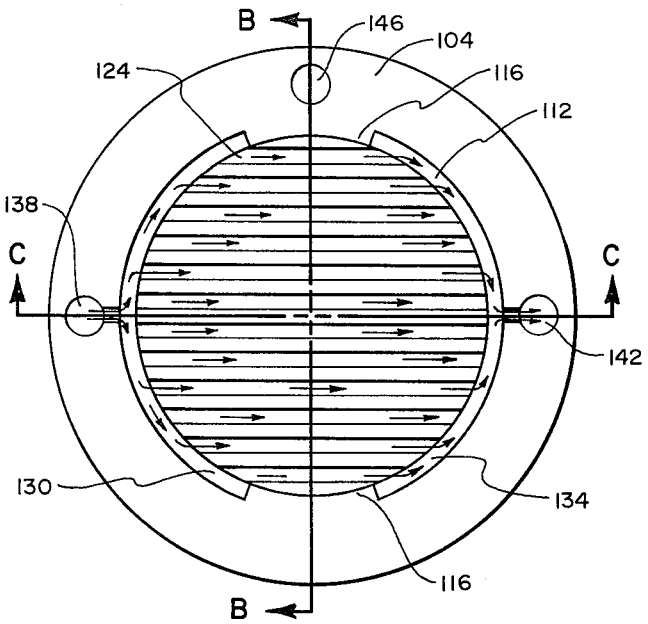
FIG. 5A is a top view of a partition and electrode plate suitable for use with the electrolysis apparatus of FIG. 1.
Figure 5B:
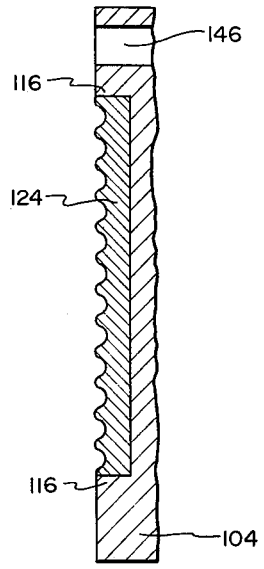
FIGS. 5B and 5C are cross-sectional views of the partition and electrode plate of FIG. 5A taken respectively along lines B—B and along lines C—C of FIG. 5A.
Figure 5C:
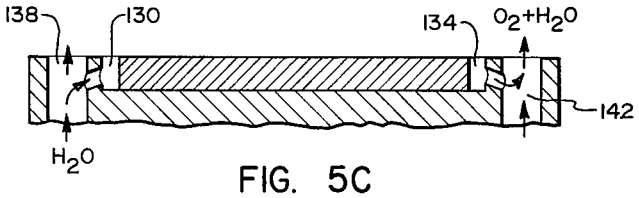

FIG. 5A shows a top plan view of another illustrative embodiment of a partition 104 and a substrate 124 suitable for use in the apparatus of FIG. 1, and FIGS. 5B and 5C show cross-sectional views of the partition and substrate of FIG. 5A taken respectively along lines B—B and C—C. As seen in FIG. 5A, the substrate 124 is circular and includes a plurality of alternating ridges and grooves on one surface thereof, with the grooves extending from one edge of the substrate generally in a linear and parallel relationship to the other edge thereof. Of course, because of the circular configuration of the substrate 124, the grooves are of different lengths. The partition 104 is formed with a hollow 112, and on either side wall of the hollow is a projecting abutment 116. The substrate 124 is inserted into the hollow 112 and held in place by the abutments 116 which contact the sides of the substrate. When the substrate is inserted in the hollow 112, chambers 130 and 134 are defined on either side of the substrate 124 as indicated in FIGS. 5A and 5C.

Conduits are formed in the partition 104 in a manner similar to those described for the partitions shown in FIGS. 1 and 2. Specifically, a conduit 138 extends perpendicularly through the partition 104 to deliver water to the chamber 130 and thus to the grooves in the substrate 124. A conduit 142 is formed to extend through the other side of the partition 104 and to receive water and oxygen from the chamber 134 which, in turn, receives the water and oxygen from the grooves of substrate 124. The flow of water and of water and oxygen is indicated in FIGS. 5A and 5C by the arrows. A third conduit 146 is also formed in the partition 104 to communicate with the hollow formed on the other side of the partition (not shown in composite FIG. 5) in a manner similar to conduit 82 of FIG. 1. Conduit 146 receives from the other hollow of each partition hydrogen and water produced by the electrolytic reaction.

FIG. 5B shows the grooves of the substrate 124 as being generally uniform in cross-sectional area. However, a groove pattern in which the grooves nearest the abutments 116 are smaller in cross-sectional area and the grooves nearest the center of the substrate 124 are larger in cross-sectional area could advantageously be provided to provide a more uniform flow of water through the grooves. That is, the shorter grooves in the substrate 124 would be smaller in cross-sectional area than the longer grooves so that the water would tend to flow more uniformly through the grooves. This feature was discussed with respect to the grooves of substrate 24 of FIG. 2C.

Figure 6A:
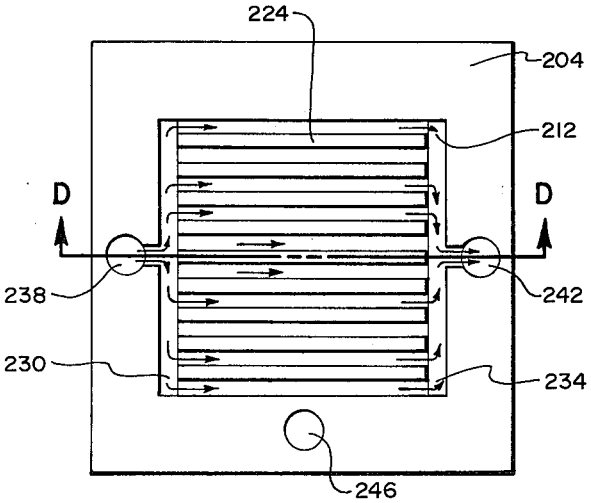
FIG. 6A is a top plan view of still another partition and electrode plate configuration suitable for use in electrolysis apparatus of the type shown in FIG. 1.
Figure 6B:
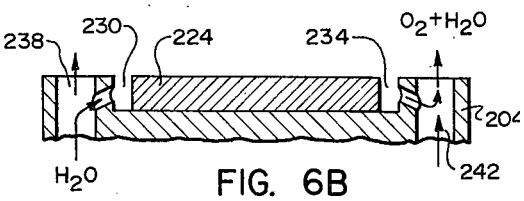
FIG. 6B is a cross-sectional view of the partition and electrode plate of FIG. 6A taken along lines D—D.

FIG. 6A shows a top plan view of still another embodiment of a partition 204 and substrates 224 which could be used in an electrolyzer of the type shown in FIG. 1. FIG. 6B shows a cross-sectional view of the partition and substrate of FIG. 6A taken along lines D—D. The substrate 224 in FIG. 6A is rectangular in shape and includes a plurality of alternating ridges and grooves extending from one edge of the substrate in a generally linear and parallel relationship to the opposite edge thereof. A hollow 212 is formed in the partition 204 to receive the substrate 224 with two sides of the substrate abuting against two sides of the hollow. Chambers 230 and 234 are defined by the hollow and the substrate 224 to be at either end of the substrate as shown in composite FIG. 6. Again, water is applied to the chamber 230 and thus to the grooves of the substrate 224 by a conduit 238 formed in the partition 204 and oxygen and water are received from the chamber 234 by a conduit 242 formed in the other side of the partition. A third conduit 246 receives hydrogen and water from the hollow formed on the other side of the partition 204 (not shown in FIGS. 6A and 6B.)

The design of the partition 204 and substrate 224 of composite FIG. 6 may be more economical to produce but, being in a rectangular shape, it is also less able to withstand high internal pressures which might be produced by the production of hydrogen. The partition and substrate structure shown in composite FIG. 5, on the other hand, being circular in configuration, may be more expensive to produce but is also more capable of withstanding high internal pressures. The partition and substrate shown in composite FIG. 2 is also able to withstand high internal pressures but may be somewhat more expensive to produce than is the partition and substrate structure of composite FIG. 6.

The electrolyzer configurations described provide an efficient and compact unit for producing hydrogen. If one of the electrolytic cells 8 of the apparatus (FIG. 1) becomes defective for any reason, then the apparatus can simply be taken apart by removing the bolts 44, and then removing and replacing the defective elements. The apparatus is thus economical to maintain.

It is to be understood that the above-described arrangement is only illustrative of the application of the principles of the present invention. Numerous other modifications and alternative arrangements may be devised by those skilled in the art without departing from the spirit and scope of the present invention and the appended claims are intended to cover such modifications and arrangements.

What is claimed is:

1. An electrode structure for electrolysis apparatus having a solid polymer electrolyte membrane and a pair of electrodes disposed on either side of and in contact with the membrane, at least one of said electrodes including a corrugated surface portion which presents alternating ridges and grooves, with the ridges being maintained in contact with the membrane so that the portions of the membrane in contact with the ridges are deformed to conform in shape to the tops of the ridges and the grooved bottoms being spaced from the membrane to enable the flow of fluid through the grooves, said corrugated surface portion extending over a generally circular area and in a substantially flat plane.

2. An electrode structure as in claim 1 wherein the tops of the ridges and the bottoms of the grooves are generally rounded

3. An electrode structure as in claim 1 wherein the tops of the ridges are generally flat, and wherein the grooves are formed to have a generally horseshoe-shaped cross-section.

4. An electrode structure as in claim 1 wherein the grooves and ridges are disposed in a substantially linear parallel relationship.

5. An electrode structure as in claim 4 wherein the cross-sectional area of the grooves extending through the circular area near the center thereof is greater than the cross-sectional area of the grooves extending through the circular area near the edges thereof.

6. An electrode structure as in claim 5 wherein the cross-sectional area of each groove is proportional to its length.

7. An electrode structure as in claim 1 wherein the ridges and grooves are formed concentrically in said surface portion substantially about the center thereof.

8. An electrode structure as in claim 7 wherein the cross-sectional area of the grooves formed concentrically near the center of the circular area is less than the cross-sectional area of the grooves formed concentrically near the edge of the circular area.

9. An electrode structure as in claim 8 wherein the cross-sectional area of each groove is proportional to the distance of the groove from the center of the circular area.

10. An electrolyzer comprising a plurality of substrates, each formed with corrugations on one side thereof to present alternating ridges and grooves and each being coated on the corrugated side with anodic material, said substrates being arranged in series so that the coated sides thereof face in the same direction, a plurality of solid polymer electrolyte membranes, one side of each of which is disposed in contact with the anodic material of a different one of said substrates, a plurality of cathode plates composed of porous cathodic material, each disposed in a generally parallel relationship and in contact with the other side of a different one of said membranes, means defining chambers about each cathode plate into which may flow gas products produced at the interfaces of the membranes and cathode plates, means for securing the substrates, membranes and cathode plates in a series relationship, means for conveying water to the grooves located on each substrate, means for applying a D.C. current to the substrates and the cathode plates, first means for receiving water and products produced at the interfaces of the membranes and anodic material, and second means for receiving products produced at the interfaces of the membranes and cathode plates.

11. An electrolyzer as in claim 10 wherein said substrates are generally rectangular and said ridges and grooves extend from near one edge of the substrates to near the opposite edge thereof, wherein said water conveying means comprises means defining a plurality of first channels, each extending generally perpendicularly to the ridges and grooves of a corresponding substrate at one end thereof and adapted to convey water to such grooves, wherein said first receiving means comprises means defining a plurality of second channels, each extending generally perpendicularly to the ridges and grooves of a corresponding substrate at the end thereof opposite the location of the first channels and adapted to receive water and products produced at the interfaces of the membranes and anodic material, and wherein said second receiving means comprises a plurality of third channels defined in the chamber defining means to communicate with and receive from the chambers products produced at the interfaces of the membranes and cathode plates.

12. An electrolyzer as in claim 10 wherein said substrates are generally circular and said ridges and grooves extend from near one edge of the substrates to near the other edge thereof generally in a parallel relationship, wherein said water conveying means comprises means defining a plurality of first channels, each extending adjacent the terminations of the ridges and grooves of a corresponding substrate at said one edge thereof to convey water to the grooves, wherein said first receiving means comprises means defining a plurality of second channels, each extending adjacent the terminations of the ridges and grooves of a corresponding substrate at said other edge thereof to receive water and products produced at the interfaces of the membranes and anodic material, and wherein said second receiving means comprises a plurality of third channels defined in the chamber defining means to communicate with and receive from the chambers products produced at the interfaces of the membranes and cathode plates.

13. An electrolyzer as in claim 12 wherein said chamber defining means comprises a plurality of partitions, each disposed between a different substrate and cathode plate and each having a generally planar profile and a hollow formed in either side thereof, one of such hollows being adapted to receive and hold a substrate and the other of such hollows being adapted to receive and hold a cathode plate, said partitions being arranged in series to maintain the anodic material of each substrate and each cathode plate in contact with and on either side of a corresponding membrane.

14. An electrolyzer as in claim 13 wherein the cross-sectional areas of the longer grooves in the substrate are greater than the cross-sectional areas of the shorter grooves.

15. An electrolyzer as in claim 10 wherein said substrates are generally circular and said ridges and grooves are formed concentrically in the substrates, wherein said water conveying means comprises a plurality of first channel means, each formed in the coated side of a different one of said substrates to extend from near the center of the substrate generally radially outwardly through the ridges to the edge of the substrate to convey water to the corresponding grooves, wherein said first receiving means comprises a plurality of second channel means, each formed in the coated side of a different one of said substrates to extend from near the center of the substrate generally radially outwardly through the ridges to the edge of the substrate to receive water and products from the corresponding grooves, each of said second channel means being spaced apart from the first channel means on the corresponding substrate, and wherein said second receiving means comprises a plurality of third channel means formed in said chamber defining means to communicate with and receive products from the chambers.

16. An electrolyzer as in claim 15 wherein the cross-sectional area of the grooves formed concentrically near the center of a substrate is less than the cross-sectional area of the outer-most grooves of the substrate.

17. An electrolyzer as in claim 14 wherein said chamber defining means comprises a plurality of partitions, each formed to have a generally planar profile with a hollow in each side thereof, one of said hollows being adapted to receive and hold a substrate and the other of said hollows being adapted to receive and hold a cathode plate, said partitions being arranged in a series relationship to maintain the anodic material of each substrate and cathode plate in contact with and on either side of a corresponding membrane.

18. An electrolyzer as in claim 17 wherein said water conveying means further comprises first conduit means formed to extend through the partitions generally perpendicularly therewith and to communicate with and convey water to each of said first channel means, wherein said first receiving means further comprises second conduit means formed to extend through the partitions generally perpendicularly therewith and to communicate with and receive water and products from each of said second channel means, and wherein said second receiving means further comprises third conduit means formed to extend through the partitions generally perpendicularly therewith and to communicate with and receive products from each of said third channel means.

19. An electrolyzer as in claim 18 wherein each first and second channel means of a substrate are formed in the substrate at an angle of about 180° apart.

20. An electrolyzer as in claim 19 wherein said first, second and third conduit means extend through the partitions at locations between the partition hollows and the outer edge of the partitions, wherein the first and second channel means extend respectively from the first and second conduit means toward the center of the substrates, and wherein the third channel means extend from the third conduit means into the hollow of each partition in which is held the cathode plate.

21. An electrolyzer as in claim 17 further including a plurality of biasing means disposed in each hollow in which a cathode plate is held to force the cathode plates against the corresponding membranes.

* * * * *